United States Patent [19]

Drzewiecki

[11] 4,276,895

[45] Jul. 7, 1981

[54] APPARATUS AND METHOD FOR TEMPERATURE COMPENSATION OF FLUIDIC CIRCUITS

[75] Inventor: Tadeusz M. Drzewiecki, Silver Spring, Md.

[73] Assignee: The United States of America as represented by the Secretary of the Army, Washington, D.C.

[21] Appl. No.: 77,442

[22] Filed: Sep. 20, 1979

[51] Int. Cl.[3] ..... F15C 1/14

[52] U.S. Cl. ..... 137/2; 137/820; 137/835

[58] Field of Search ..... 137/835, 820, 804, 805, 137/2; 73/357

[56] References Cited

U.S. PATENT DOCUMENTS

| | | | |
|---|---|---|---|
| 3,223,101 | 12/1965 | Bowles | 137/820 |
| 3,314,294 | 4/1967 | Colston | 73/357 |
| 3,425,430 | 2/1969 | Horton | 137/835 |
| 3,443,574 | 5/1969 | Posingies | 137/820 |
| 3,474,805 | 10/1969 | Swartz | 137/835 |

FOREIGN PATENT DOCUMENTS

| | | | |
|---|---|---|---|
| 1456877 | 9/1966 | France | 137/835 |

*Primary Examiner*—William R. Cline

*Attorney, Agent, or Firm*—Nathan Edelberg; Robert P. Gibson; Saul Elbaum

[57] ABSTRACT

A temperature compensation device for a fluidic circuit is disclosed. The device comprises a high gain fluid amplifier having input and feedback resistors. The resistance to fluid flow through the input resistor is dependent upon fluid density, while the resistance to flow through the feedback resistor is dependent upon fluid viscosity.

8 Claims, 4 Drawing Figures

APPARATUS AND METHOD FOR TEMPERATURE COMPENSATION OF FLUIDIC CIRCUITS

RIGHTS OF THE GOVERNMENT

The invention described herein may be manufactured, used and licensed by or for the U.S. Government for governmental purposes without the payment to me of any royalty thereon.

BACKGROUND OF THE INVENTION

Fluid viscosity changes with temperature. Gases exhibit increasing viscosity with increasing temperature, while liquids exhibit decreasing viscosity with increasing temperature. Fluidic circuits are normally viscosity, therefore temperature, dependent. The gain of a fluidic circuit or amplifier gain block decreases with increasing fluid viscosity. It is often desirable to compensate for this variation in gain of a fluidic circuit.

It is therefore an object of the invention to provide means for compensating a fluidic circuit for decreases in gain resulting from variations in temperature.

It is a further object of the invention to provide a compensation device having no moving parts.

It is an additional object of the invention to provide means for compensating a fluid circuit which may be added to the final circuit, thus obviating the need to compensate individual components of the circuit.

It is yet another object of the invention to provide a fluidic circuit temperature compensating means which does not materially affect circuit complexity.

SUMMARY OF THE INVENTION

This invention provides a circuit element which is placed in the signal path of a fluidic circuit, the gain of which increases with increasing viscosity. The net effect is to counteract the circuit gain decrease. The device comprises essentially a modified fluidic operational amplifier, a high-gain amplifier with feedback and input fluid resistors. Operational amplifiers are normally designed with input and feedback resistors of substantially the same type, e.g. two orifices or two capillaries to prevent dependence of the amplifier on changes in fluid properties. The device of the invention utilizes a feedback resistor which is specifically chosen as one which is dependent on fluid viscosity, and an input resistor which is specifically chosen to be dependent upon fluid density.

In general, if the gain of the high-gain amplifier in an operational amplifier is greater than 40, and the input to output impedence ratio is greater than 1.0, the gain of the operational amplifier is the ratio of the feedback resistance to the input resistance, as long as the resistance ratio is of the order of 1.0. The gain of the compensator can, therefore, be expressed as follows:

$$G_p = R_f / R_i$$

wherein $G_p$ = compensator gain $R_f = K_1\mu$; ($\mu$ is absolute fluid viscosity)

$R_i = K_2\rho$; ($\rho$ is fluid density)

Therefore, $G_p = K_3\gamma$; ($\gamma$ is kinematic viscosity)

and definitionally, $$G_p = \Delta P_0 / \Delta P_i$$

wherein $\Delta P_0$ and $\Delta P_i$ are the pressure differentials across the compensator outputs and inputs, respectively. Therefore, the gain of the compensator is directly proportional to the kinematic viscosity of the fluid.

DESCRIPTION OF THE PREFERRED EMBODIMENT

Figure 1:
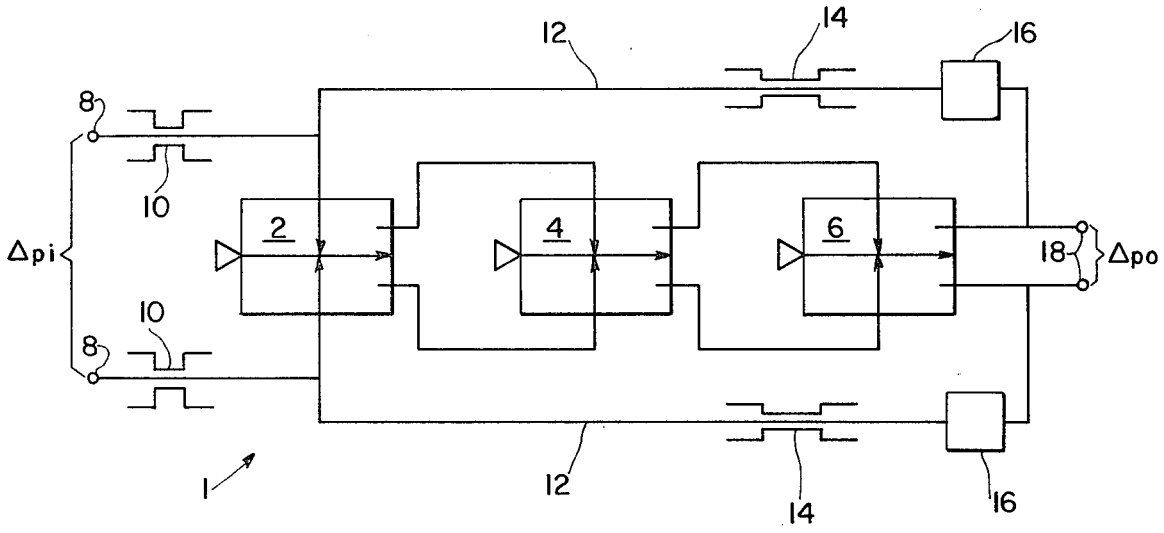
FIG. 1 is a schematic representation of the compensator of the invention.

FIG. 1 shows the compensator of the invention, generally designated by the reference numeral 1. The device comprises a high gain fluidic amplifier, here composed of a series of amplifiers 2, 4, and 6. Inputs 8 are adapted to be connected to the signal outputs of a fluidic circuit. Flow resistors 10 in the input paths have a resistance to fluid flow which is dependent upon the density of the fluid. These resistors may be of the orifice type. Feedbacks paths 12 comprise flow resistors 14, the resistance of which is dependent upon fluid viscosity. Resistors 14 may comprise a capillary or sintered plug. Volume 16 acts as a capacity to ground the circuit, to prevent oscillation.

Figure 2:
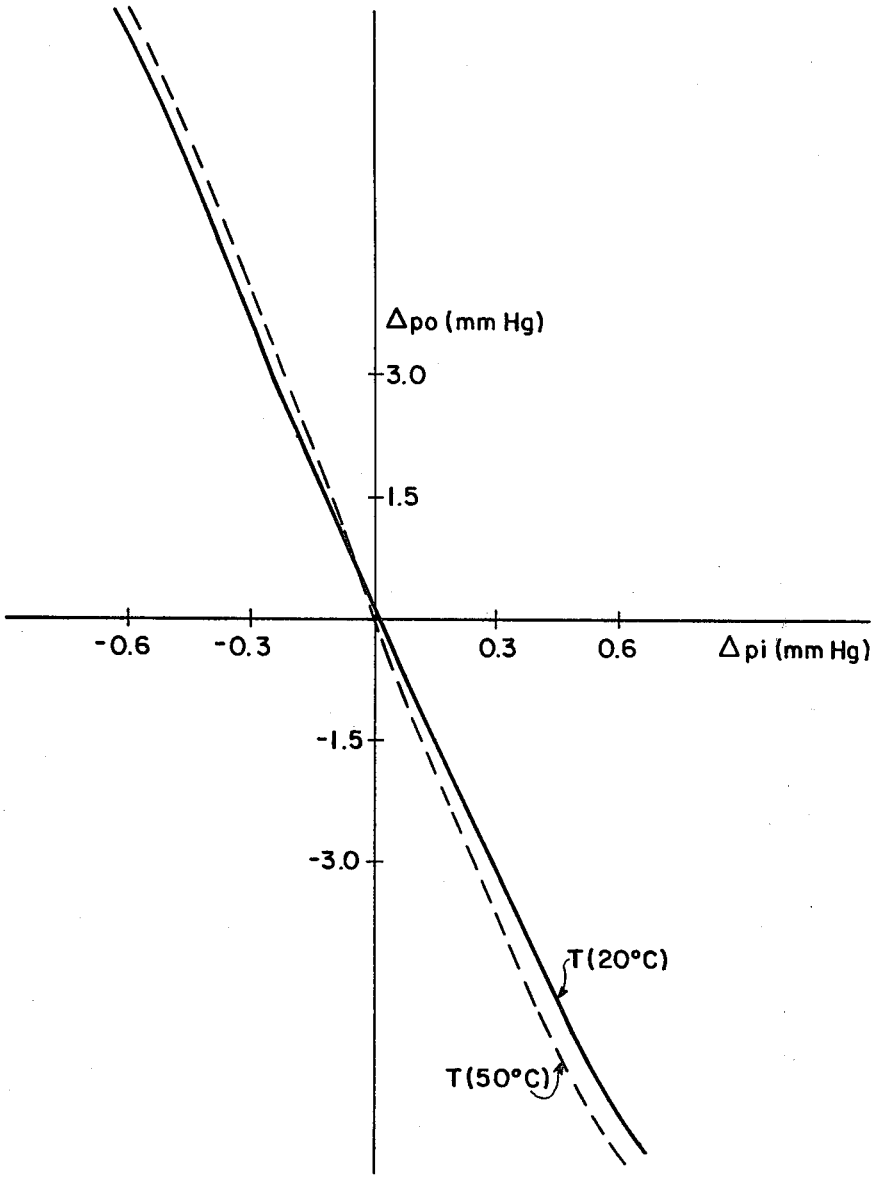
FIG. 2 is a graphical representation of the performance of the compensator of the invention.

In operation, signals from the fluidic circuit to which the compensator is attached will generally cause a pressure differential to exist across the inputs 8. This is shown as $\Delta P_i$ in FIG. 1. This pressure differential will in turn generate a pressure differential $\Delta P_o$ across outputs 18 of the compensator. As noted above, the gain of the compensator can be expressed as the ratio of differential output pressure to the differential input pressure. FIG. 2 graphically illustrates the results of a test performed on a compensator as illustrated in FIG. 1. The differential input pressure is plotted on the horizontal axis, while the differential output pressure is plotted on the vertical axis. The slope of the respective lines represents the gain of the compensator. Air was used as the test fluid. The slope of the line is 11.0 at an air temperature of 20 degrees centigrade, and changes to a slope of 13.0 at a temperature of 50 degrees centigrade. This represents an 18 percent increase in gain, which corresponds to a 19 percent increase in kinematic viscosity of the air. It can thus be seen that the gain of the compensator increases with increasing fluid viscosity, which will compensate for decreases in gain experienced by a fluid circuit.

Figure 3:
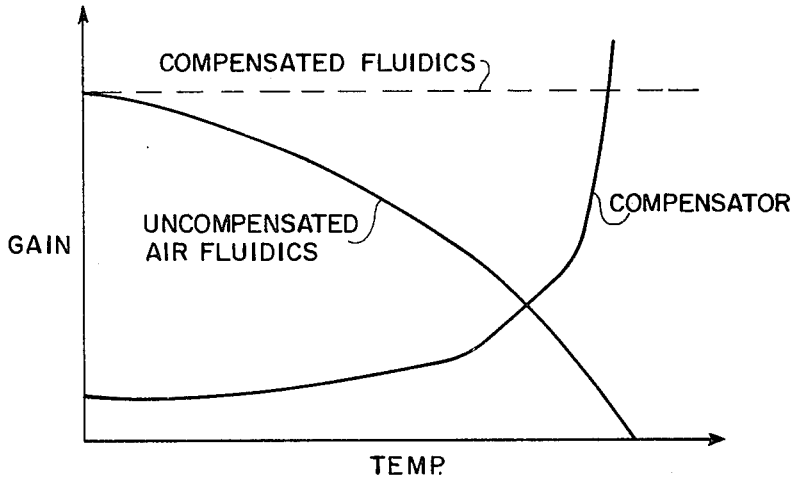
FIG. 3 shows the gain of a circuit with and without the compensator of the invention, and the gain of the compensator.

FIG. 3 graphically illustrates how the compensator, when combined with a fluid circuit, will effectively counteract decreases in gain experienced by the fluidic circuit as a result of increased temperature. The uncompensated fluidic circuit has a gain which decreases with increasing temperature. The fluid compensator of the invention has a gain which increases with temperature, as previously described. When the compensator is connected in series with the uncompensated fluidic circuit, the gain of the circuit and the compensator are multiplicative. Therefore, the increase in the compensator gain will offset the decrease in the circuit gain, resulting in a constant gain for the combination of the circuit and the compensator, as illustrated by the dashed line in FIG. 3.

Figure 4:
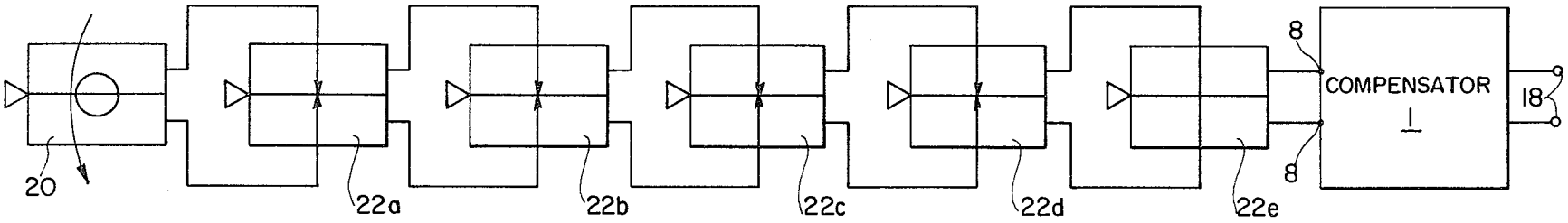
FIG. 4 is an illustration of the compensator in combination with a fluid circuit, to provide compensation therefor.

FIG. 4 illustrates how a compensator of the invention may be combined with a fluidic circuit to provide compensation for the circuit. A typical circuit, as illustrated, comprises a laminar jet angular rate sensor (LJARS) 20 connected in series with a series of 5 laminar proportional amplifiers (LPA) 22a–22e. For a 50% decrease in kinematic fluid viscosity, the gain of a typical LPA will increase about 10%, while the sensitivity of a standard LJARS will increase about 50%. Therefore, a circuit as shown in FIG. 4, comprising an LJARS and 5 LPA's will have a gain which will increase by 100%, or double. The compensator, 1, has a gain which will decrease by 50%, or halve, in response to the 50% decrease in the kinematic viscosity of the fluid. Since the net gain of the composite circuit of FIG. 4 is the product of the gain of the uncompensated circuit and the gain of the compensator, the result is a net change of 0% in gain.

The invention provides a compensation device in which no moving parts or complicated flow regulators are required. A significant advantage of the device of the invention is that it is add-on, and does not materially affect system complexity. One need not specifcially compensate individual circuit components. Rather, one compensates the final total circuit. The amount of compensation provided by the device of the invention can be increased or decreased by judicious selection of resistors or by connecting several compensators in series to gain the multiplicative effect of such a series of compensators.

The above description is not meant to be limiting to the details described and shown therein, as obvious modifications will be made by those skilled in the art.

I claim:

1. A temperature compensator for a fluidic circuit comprising, fluid amplification means having control inputs and having an output corresponding to each control input, a feedback path from each output to a respective one of said control inputs, a first resistor associated with each control input, said first resistor having a resistance to fluid flow which is proportional to density of a fluid flowing therethrough, and a second resistor in each feedback path, said second resistor having a resistance to fluid flow which is proportional to the viscosity of a fluid flowing therethrough.

2. A temperature compensator as in claim 1, wherein said fluid amplification means comprises at least one fluid proportional amplifier having said control inputs and said outputs.

3. A temperature compensator as in claim 2, wherein said fluid amplification means comprises a series of cascaded fluid proportional amplifiers, said first resistors being associated with the control inputs of a first one of said series of amplifiers, and said feedback paths extending from the outputs of a last one of said series of amplifiers to the control inputs of said first one of said series of amplifiers.

4. A temperature compensator as in claim 1 or 2, wherein said fluid amplification means has a gain greater than 40.

5. A temperature compensator as in claim 1 or 2 wherein said first resistor is an orifice type resistor.

6. A temperature compensator as in claim 1 or 2, wherein said second resistor is a capillary type resistor.

7. A temperature compensator as in claim 1 or 2, wherein said second resistor is a sintered plug type resistor.

8. In a fluidic circuit comprising at least one fluidic element having dual outputs for fluid flow, a method for compensating said circuit for changes in gain due to variations in temperature of the fluid in said circuit, said method comprising, directing the fluid flow from said outputs of said circuit to respective dual control inputs of a fluid proportional amplifier, regulating the flow through said control inputs in accordance with the density of the fluid flowing therethrough, controlling the output of said fluid proportional amplifier in response to the flow through said control inputs and directing the output of said amplifier through two output paths, feeding back at least a portion of the flow from the respective two output paths of said amplifier to the respective control inputs thereof, and regulating the flow feeding back to said control inputs in accordance with the viscosity of the fluid, whereby the output flow from the fluid proportional amplifier represents the output from said fluidic circuit compensated for variations in temperature of the fluid in the circuit.

* * * * *